US006871361B2

(12) United States Patent
Grech et al.

(10) Patent No.: US 6,871,361 B2
(45) Date of Patent: Mar. 29, 2005

(54) FLUSH TOILETS FOR RV'S AND BOATS

(75) Inventors: George Grech, Garden City, MI (US); John E. Hammond, Redford, MI (US); James Kenneth Miller, Ypsilanti, MI (US)

(73) Assignee: Thetford Corporation, Ann Arbor, MI (US)

( * ) Notice: Subject to any disclaimer, the term of this patent is extended or adjusted under 35 U.S.C. 154(b) by 0 days.

(21) Appl. No.: 10/611,338

(22) Filed: Jul. 1, 2003

(65) Prior Publication Data

US 2004/0088783 A1 May 13, 2004

Related U.S. Application Data

(62) Division of application No. 10/162,535, filed on Jun. 4, 2002, now Pat. No. 6,584,623, which is a division of application No. 09/547,121, filed on Apr. 11, 2000, now Pat. No. 6,397,405.

(51) Int. Cl.[7] ..... E03D 11/17

(52) U.S. Cl. ..... 4/252.5; 4/252.1

(58) Field of Search ..... 4/252.1, 252.4, 4/252.5, 252.6, 434, 438, 440–442

(56) References Cited

U.S. PATENT DOCUMENTS

| | | | | | |
|---|---|---|---|---|---|
| 845,534 | A | * | 2/1907 | Delanoy | 4/252.1 |
| 939,001 | A | * | 11/1909 | Forester | 4/252.5 |
| 1,005,751 | A | * | 10/1911 | Schweitzer | 4/252.5 |
| 1,878,195 | A | * | 9/1932 | Sisk | 285/58 |
| 3,851,339 | A | | 12/1974 | Flinner et al. | 4/115 |
| 4,075,718 | A | | 2/1978 | Hargraves | 4/300 |
| 4,515,398 | A | * | 5/1985 | Machon, Sr. | 285/59 |
| 4,581,779 | A | | 4/1986 | Matsui et al. | 4/420.2 |
| 4,713,847 | A | | 12/1987 | Oldfelt et al. | 4/316 |
| 4,918,764 | A | | 4/1990 | Haselswerdt et al. | 4/406 |
| 4,926,508 | A | | 5/1990 | Sargent et al. | 4/329 |
| 5,010,602 | A | | 4/1991 | Sargent et al. | 4/432 |
| 5,073,994 | A | | 12/1991 | Sargent et al. | 4/432 |
| 5,121,511 | A | | 6/1992 | Sakamoto et al. | 4/601 |
| 5,123,124 | A | | 6/1992 | Brower | 4/234 |
| 5,432,957 | A | * | 7/1995 | Fernie et al. | 4/252.4 |
| 5,715,544 | A | | 2/1998 | Huffman et al. | 4/420 |
| 5,875,499 | A | | 3/1999 | Hoffman et al. | 4/420 |
| 5,898,956 | A | | 5/1999 | Kurisaki et al. | 4/420.4 |
| 6,070,276 | A | | 6/2000 | Yeung | 4/442 |
| 6,076,200 | A | | 6/2000 | Yeung | 4/442 |
| 6,145,138 | A | | 11/2000 | Nakamura et al. | 4/425 |
| 6,397,405 | B1 | | 6/2002 | Grech et al. | 4/420 |

FOREIGN PATENT DOCUMENTS

| | | |
|---|---|---|
| DE | 2921785 | 12/1979 |
| GB | 303036 | of 1913 |
| GB | 2045311 A | 10/1980 |
| JP | 5-230863 | 9/1993 |

* cited by examiner

*Primary Examiner*—Gregory L. Huson
*Assistant Examiner*—Huyen Le
(74) *Attorney, Agent, or Firm*—Harness, Dickey & Pierce, P.L.C.

(57) ABSTRACT

A flush toilet having two nozzles located within its bowl. The two nozzles being oriented in opposite directions and alternately providing pulses of flush water into and around the bowl.

17 Claims, 9 Drawing Sheets

FLUSH TOILETS FOR RV'S AND BOATS

CROSS-REFERENCE TO RELATED APPLICATION

This is a divisional of an application filed Jun. 4, 2002 and assigned U.S. Ser. No. 10/162,535, now U.S. Pat. No. 6,584,623 which is a divisional of an application filed Apr. 11, 2000 and assigned U.S. Ser. No. 09/547,121 (now U.S. Pat. No. 6,397,405).

BACKGROUND AND SUMMARY OF THE INVENTION

The present invention relates to a low-water flush toilet and in particular to a toilet providing multiple pulse jets of flush water moving in opposite directions on ledges provided on the toilet bowl near its upper end. The flush water applied to the inner surface of the bowl is carefully controlled to produce consistent and repeatable flushing operations.

Water shortages on RV's and boats lead to the use of low-water flush toilets. In some situations, in boats and RV's, conservation of water is essential. The new flush system of this invention is created by providing dual nozzles at the back of the toilet bowl for providing alternating pulses of water from each nozzle, directed so that the water will move along ledges which extends on the sides of the bowl to the front of the bowl, the movement of each pulse of flush water providing for uniformed wetting of one half of the bowl surface below the ledge. The nozzle are directed in opposite directions so that when viewed from above, one jet of flush water will be moving counter-clockwise (from the back of the bowl to the front of the bowl) and the other jet of flush water will be moving in a clockwise direction (from the back of the bowl to the front of the bowl). As a result, total wetting of the bowl will be achieved because each volume of pulsed water can be controlled so as to totally wet half of the bowl, in contrast to previous pulsed flush toilets in which the pulsed water must wet the entire bowl in one pulse.

During flushing, a slide valve at the bottom of the bowl will be opened to allow the pulsed water in the bowl to move the entire content of the bowl into a holding tank below the outlet.

The slide valve is connected through a clutch to an actuator and this prevents damage to the slide valve in the event of a blockage at the outlet. In such case, the actuator would simply "free wheel" without moving the slide valve.

Furthermore, a slip tube or spacer allows variable height positioning of the bowl to meet the demands of the RV and boat industry. The slip tube provided in this toilet to allow the same toilet to be offered to customers in variable heights without adding unnecessary costs because the remaining mechanics of the toilet remain the same. A slip tube spacer is provided to allow the slide valve to be positioned a further distance from the holding tank in a higher (taller) version of the toilet. The slip tube or spacer also ensures a "no leak" path for water from the bowl to the floor to accommodate small variances in dimensions in bowls.

In light of the above, it is an object of the present invention to provide a toilet that consistently cleans the bowl's surface using a minimum quantity of water. Further, the electronic controls enable easy flushing of the toilet by the user, having only to depress a control button. A second button when depressed adds water to the bowl to enable the user to leave the toilet with the desired amount of water in the bowl.

The following U.S. Patents, owned by the assignee of this application, utilize "ledges" and pulsed flush water:

U.S. Pat. No. 4,926,508

U.S. Pat. No. 5,010,602

U.S. Pat. No. 5,073,994

U.S. Pat. No. 5,715,544

U.S. Pat. No. 5,875,499

Further objects, features and advantages of the invention become apparent from a consideration of the following description and dependent claims when taken in connection with the accompanying drawings.

DETAILED DESCRIPTION OF THE PREFERRED EMBODIMENTS OF THE INVENTION

Figure 1:
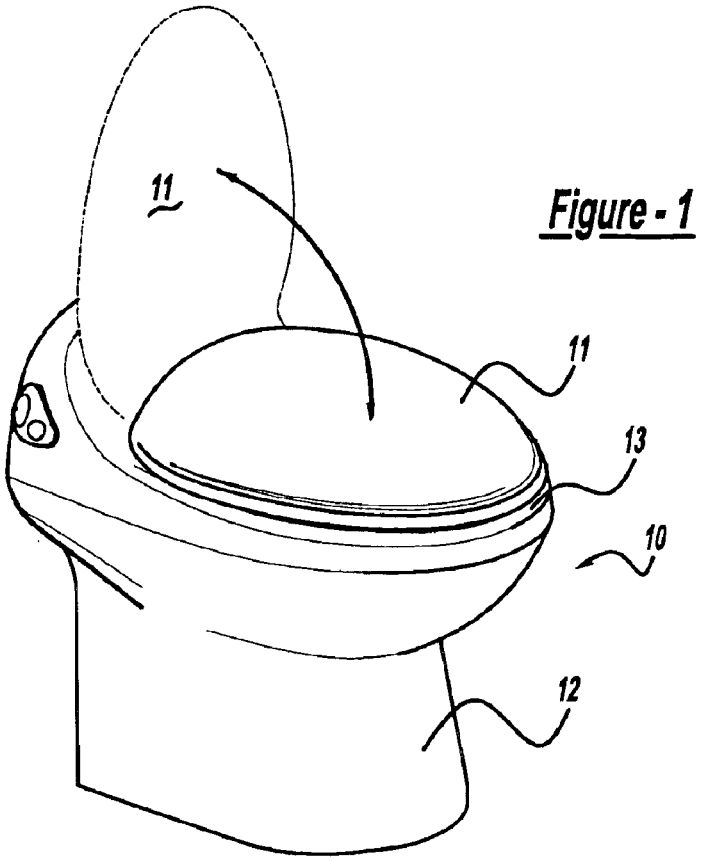
FIG. 1 is a perspective view of the toilet of this invention.
Figure 2:
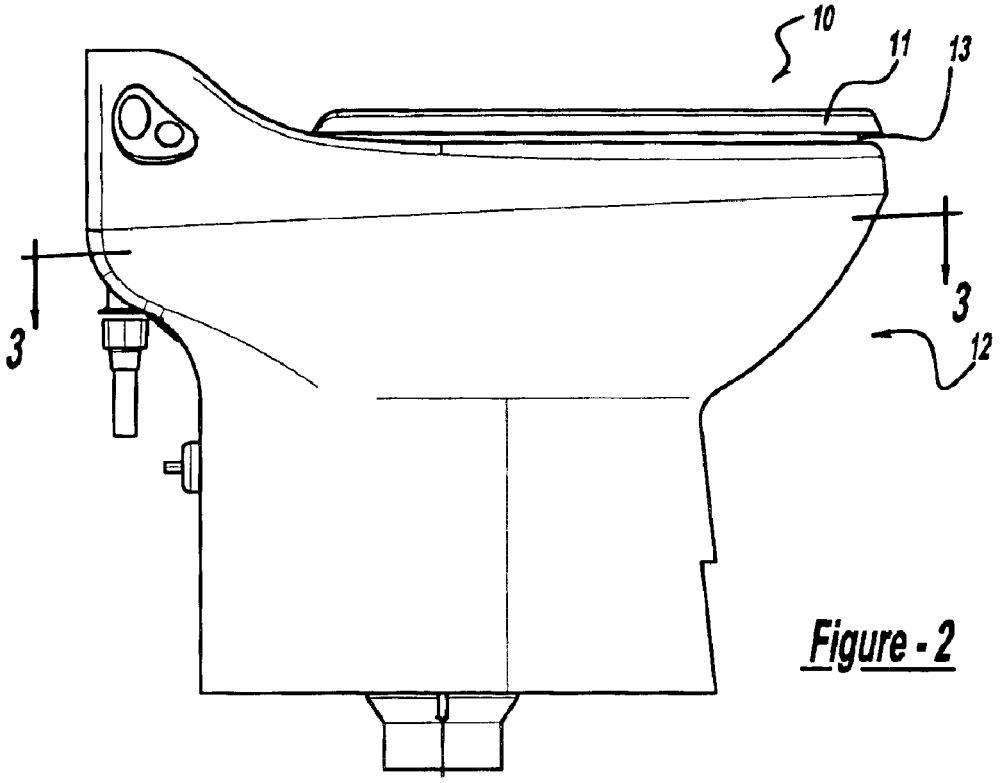
FIG. 2 is a side elevational view of the toilet shown in FIG. 1.
Figure 4:
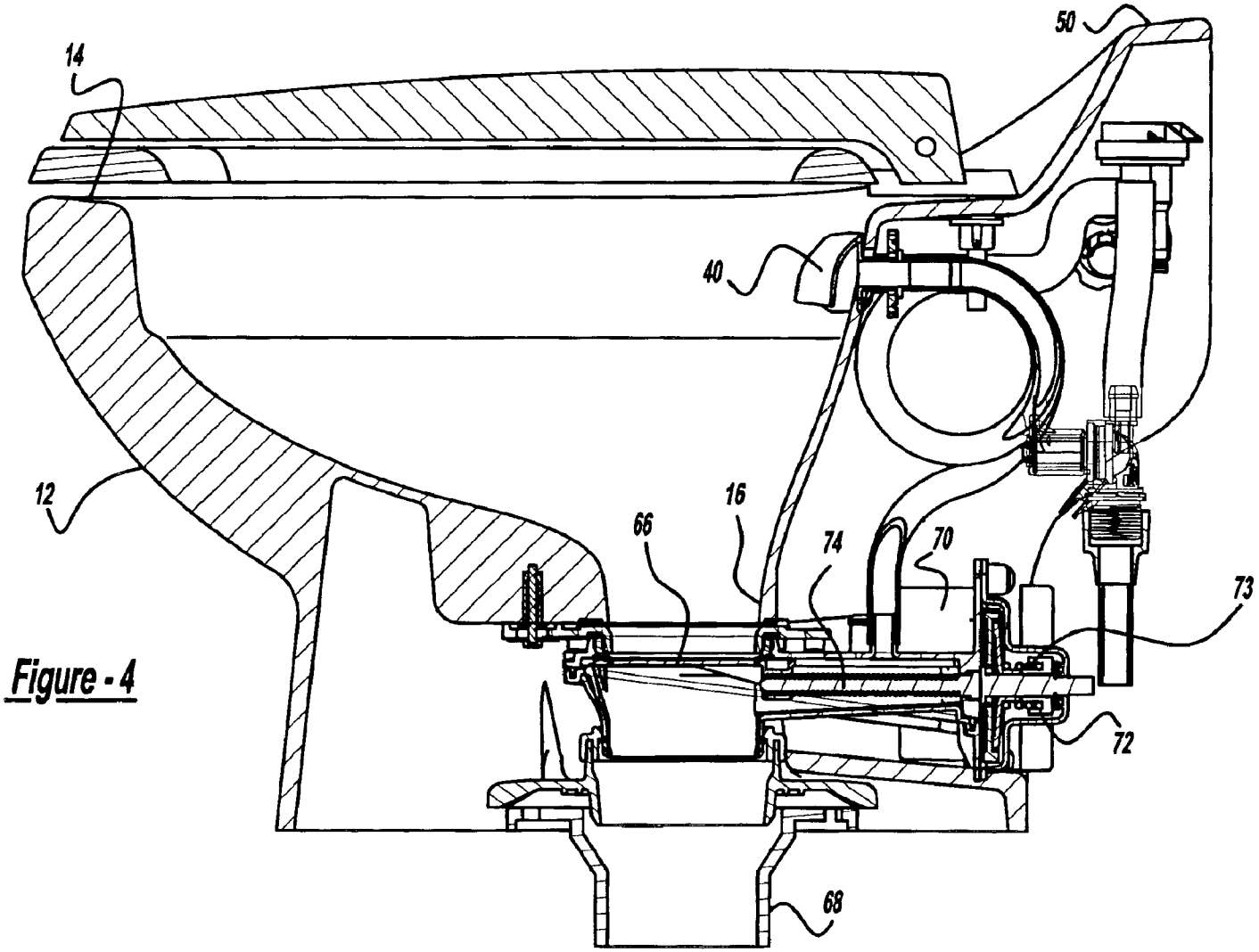
FIG. 4 is a cross-sectional view of the toilet in this invention as seen substantially from the line 4—4 in FIG. 3.
Figure 5:
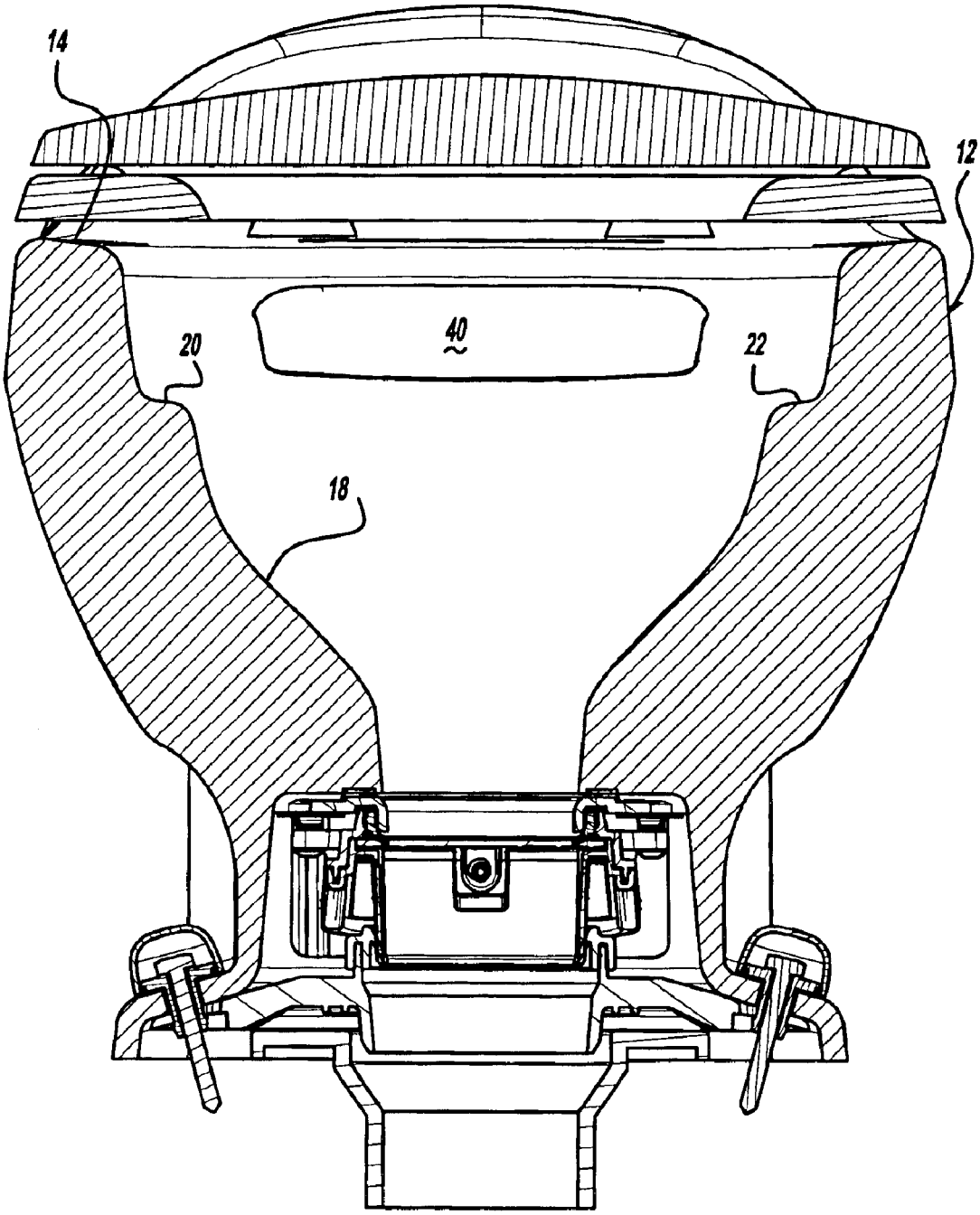
FIG. 5 is a cross-sectional view of the toilet in this invention as seen substantially from the line 5—5 in FIG. 3.

The flush toilet of this invention is shown at FIGS. 1 and 2 and designated generally at 10. The toilet 10 includes a bowl 12 made of china to provide a feeling of being home when using the toilet. The usual cover 11 and seat 13 rest on the bowl 12 when not in use. As shown in FIG. 4, the bowl 12 has an upper end 14 and a lower discharge outlet 16. The inner surface 18 of the bowl 12 is formed with left and right hand ledges 20 and 22 each of which extends from the back 24 of the bowl 12 to the front 26 of the bowl 12. As used throughout the specification and claims the term "ledge" is used to refer to a portion of the bowl surface 18 having a slope or an incline that is closer to horizontal than the slope of the surrounding bowl surface both below and above the ledge.

A nozzle 30 is mounted on the back 24 of the bowl 12 at a position adjacent the end 36 of ledge 20 at the back 24 of the bowl 12. A second nozzle 32 is similarly mounted on the back 24 at a position adjacent the end 36 of ledge 22 adjacent the back 24. Water comes out of each of the nozzles 30 and 32 as primarily horizontally directed jets. In a preferred embodiment, the nozzles 30 and 32 each include orifices, an inboard orifice and an outboard orifice, connected by a slot. The outboard orifices are larger in diameter than the inboard orifices such that water is primarily ducted along the ledges toward the front of the bowl 12.

It should be noted that the ledges 20 and 22 are contoured so that they are wide at their ends 36 where the pulsed jet of flush water first hits the ledge and are slimmer at the ends 38. This contour ensures that all of the bowl surface 18 is uniformly wetted to achieve continuous cleaning of the surface 18 when the toilet 10 is flushed.

A drain pipe 34 is mounted on the back 24 of the bowl 12 to avoid water in the bowl 12 overflowing out of the toilet 10.

Figure 3:
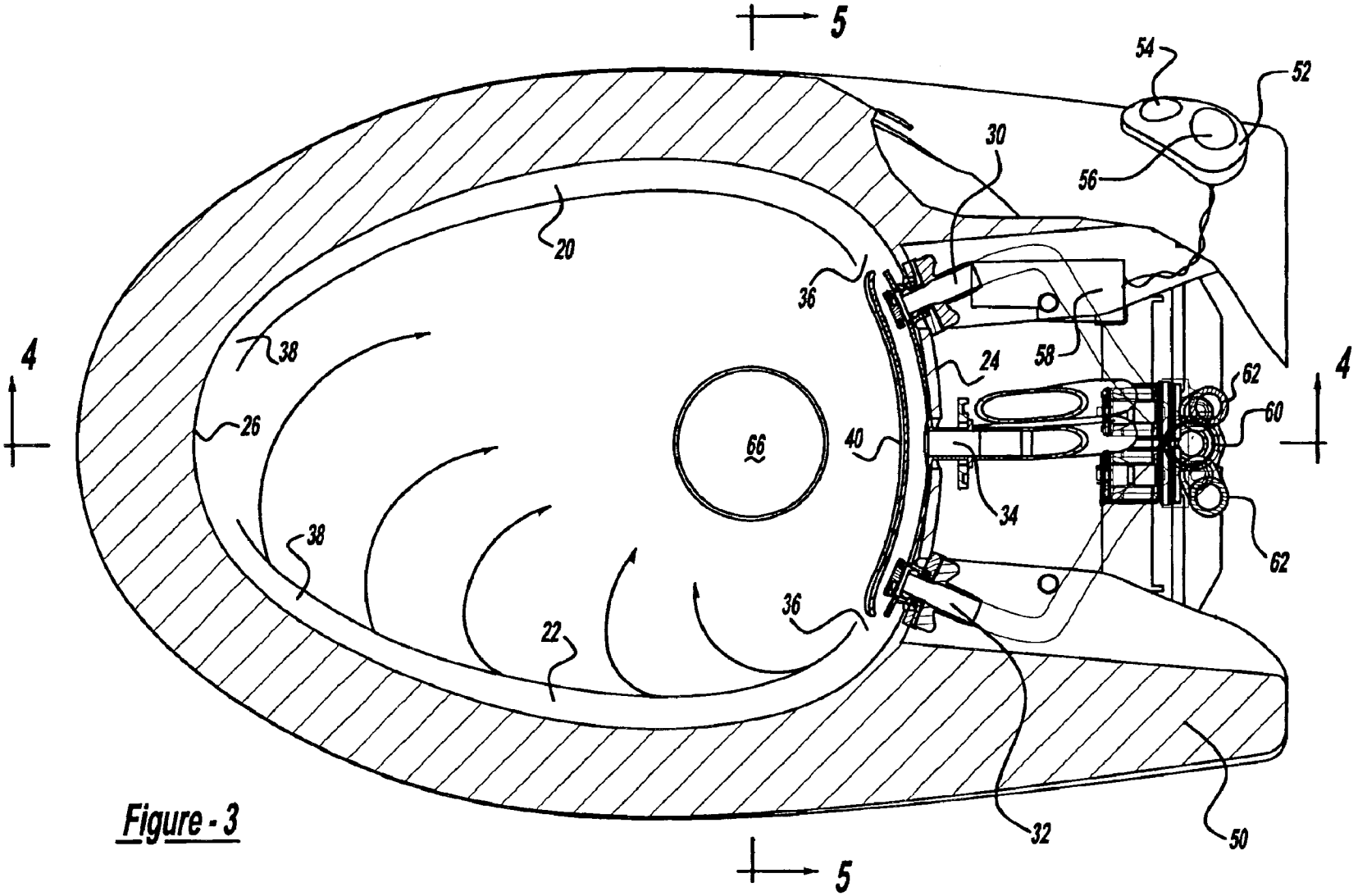
FIG. 3 is an enlarged sectional view of the toilet of this invention as seen substantially from the line 3—3 in FIG. 2.
Figure 6A:
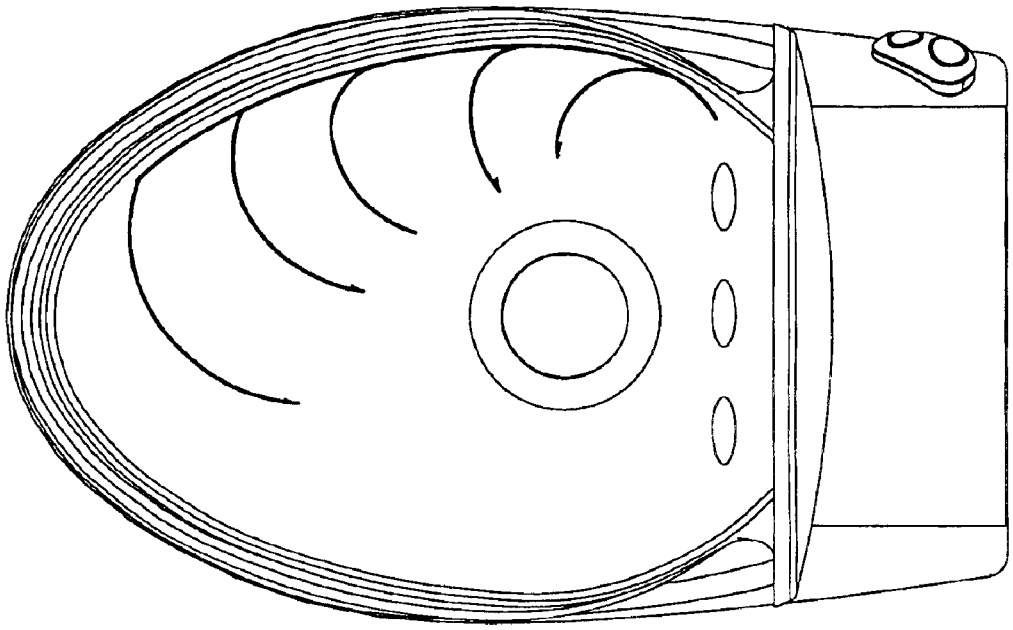
FIGS. 6*a* and 6*b* are diagrammatic plan views of the toilet bowl to visually show the alternate pulses of flush water
Figure 6B:
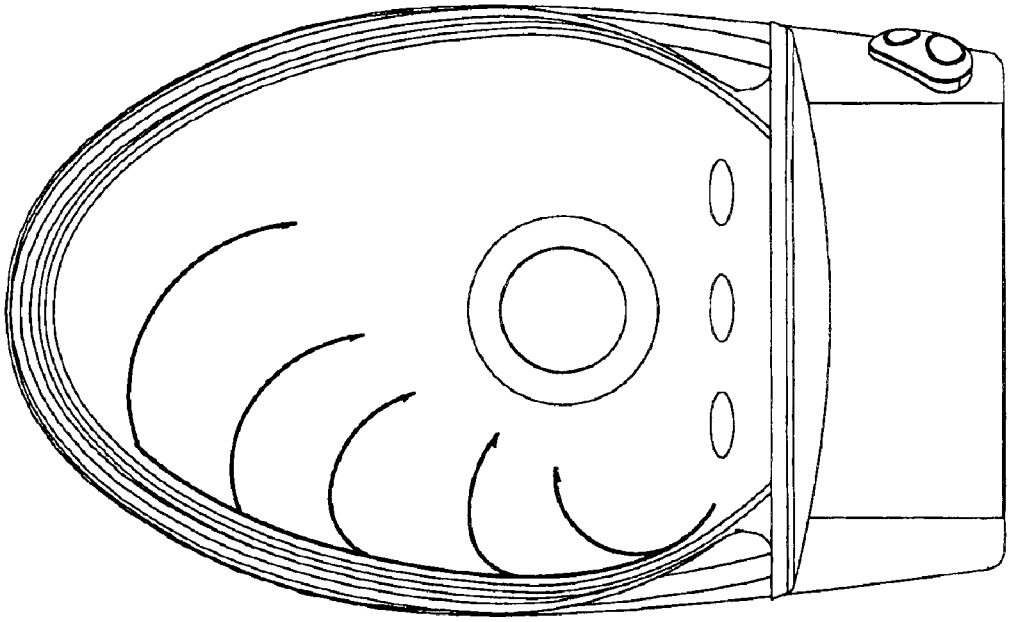

An arcuate cover 40 is mounted in the bowl 12 at the rear 24 to cover the nozzles 30 and 32 and the drain 34. As shown in FIG. 4, the cover 40 is spaced ahead of the nozzles 30 and 32 to avoid flush water splashing on a user of the toilet 10. Flush water from the nozzle 30 (FIG. 6*a*) will follow a path which is counter-clockwise and the flush water from nozzle 32 will follow a clockwise path as shown in FIGS. 3 and 6*b*. It is to be noted that the flush water will fall onto the bowl surface 18 below the ledges 20 and 22 but neither ledge will have water flowing very far from the end 38 of the ledge. The electronic controls, not yet explained, and the water system limit the pressure of the pulses so that they lose their momentum without proceeding much beyond the ends of the ledges 20 and 22.

A rearward extension 50 of the bowl 12 supports the water systems and the controls that provide the necessary amenities for the toilet. A pad 52 on the extension 50 is in a location where it can be readily reached by a user sitting on the toilet. Push buttons 54 and 56 are electrically connected to a circuit board 58, which controls a dual solenoid water valve 60 so that when the flush button 54 is depressed the dual solenoid water valve 60 provides water alternatively to the nozzles 30 and 32. In this manner water from each nozzle 30 and 32 is under enough pressure that it will travel on the ledge 20 from the rear end 36 to the front end of the ledge 38 with water running off the ledge and down the bowl surface toward the outlet at all times as the water travels lengthwise along the ledge 20. Under the control of the circuit board 58, water through the nozzle 30 is then discontinued when it is timed out. Just before nozzle 30 times out, the circuit board 58 causes water to be supplied through the nozzle 32 which provides the same performance on the ledge 22 from end 36 to end 38. The controller is programmed to stop alternating the supply of water to the nozzles 30 and 32 after a certain time. When the nozzles are "on", the jets are at desired pressure capable of wetting the bowl uniformly with water without danger of having water run up and out of the bowl 12. The appropriate design and construction of the circuit board will be apparent to one skilled in the art depending on the specific design criteria of the toilet 1 with which it is used.

Figure 9:
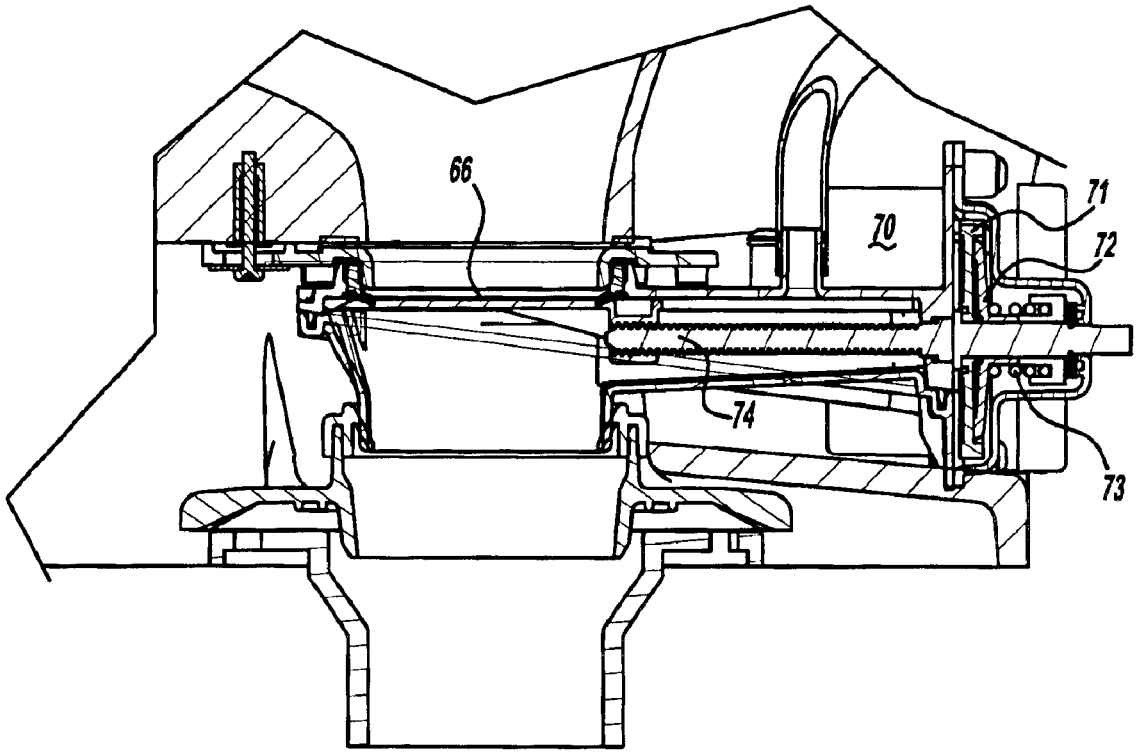
FIG. 9 is a fragmentary cross-sectional view of the slide gate valve at the outlet opening of the bowl and the clutch driven actuator which moves the valve.
Figure 10:
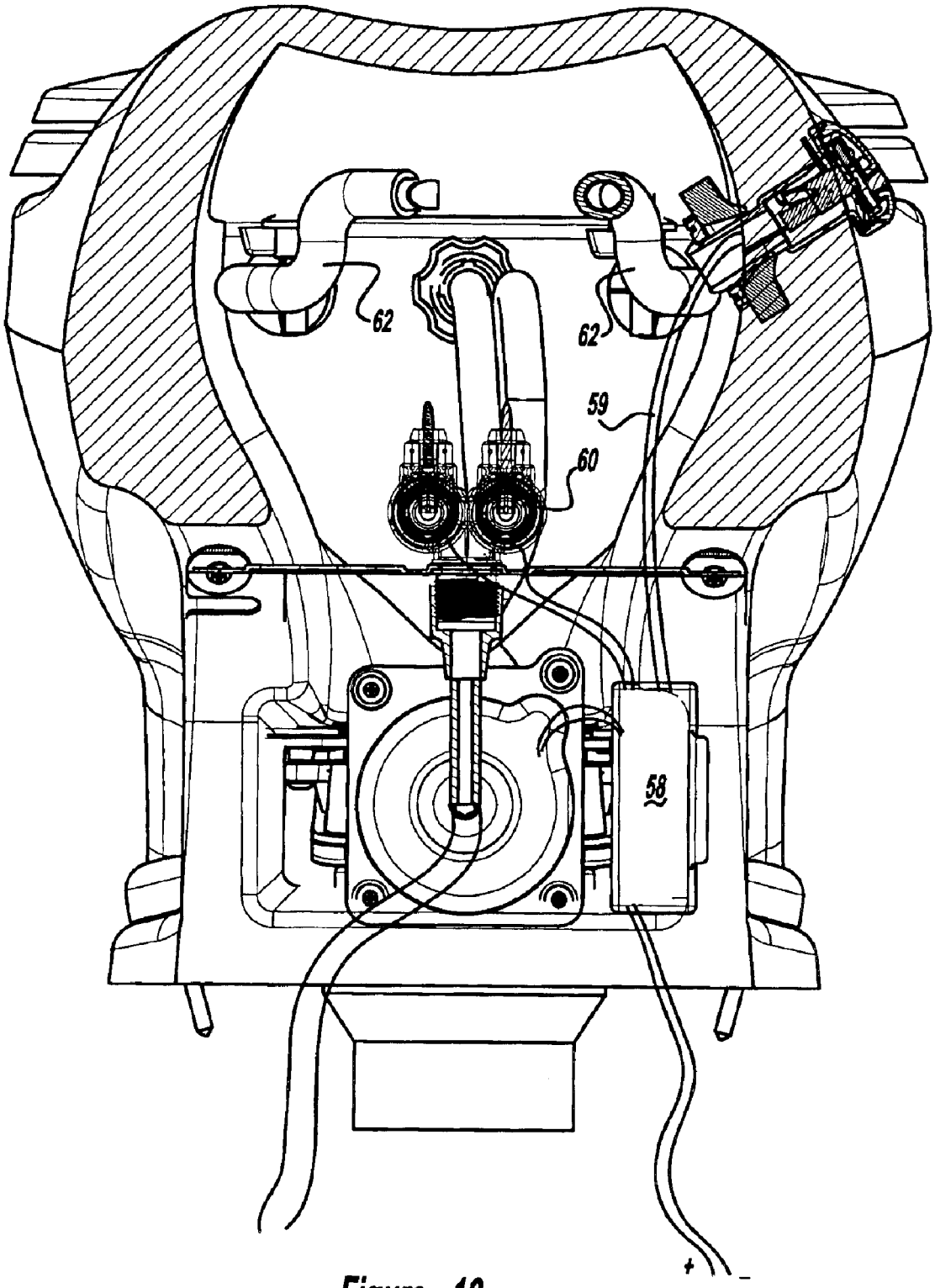
FIG. 10 is a cross-sectional view near the back of the bowl showing the electronic controls that actuate the operation of the nozzles that supply the flush water pulses and the opening and closing of the waste valve plate.

A motor driven slide blade 66 (FIGS. 4 and 9) is movable between a closed position and an open position in which the contents of the bowl 12 can drop through the outlet 68 and into a suitable holding tank (not shown). A motor 70 drives a plate 71 which meshes with a driven plate 72 which in turn drives a screw 74 that is engaged and operable to move the slide gate valve 66 between open and closed positions. In the event of a blockage at the outlet 16 which is engaged by the slide valve 66, the clutch formed by plates 71 and 72 will begin to slip relative to one another causing plate 72 to move axially away from and out of meshed engagement with plate 71, against the biasing the spring 73, stopping rotation of the screw 74.

As an alternative to the mechanical clutch system described above, the invention could alternately employ an electric clutch. Such a clutch, in one embodiment, current being drawn by the motor 70 is monitored. Upon sensing an increase or spike in drawn current, indicating blocked movement by the blade 66, the motor 70 would be shut down or reversed. The system would then periodically operate the motor 70 to determine if the blockage has be removed.

Figure 7:
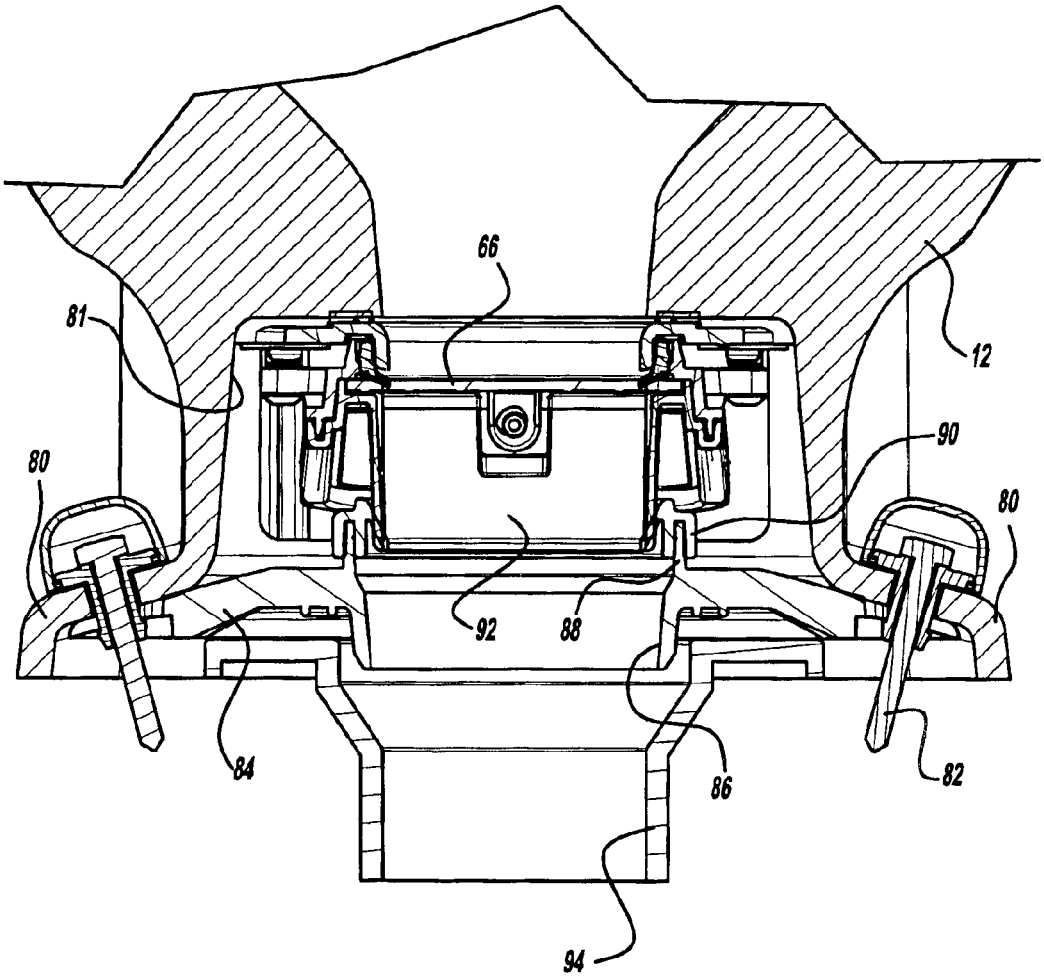
FIG. 7 is an enlarged fragmentary version of FIG. 5 to show the structure that supports the toilet on the floor.
Figure 8:
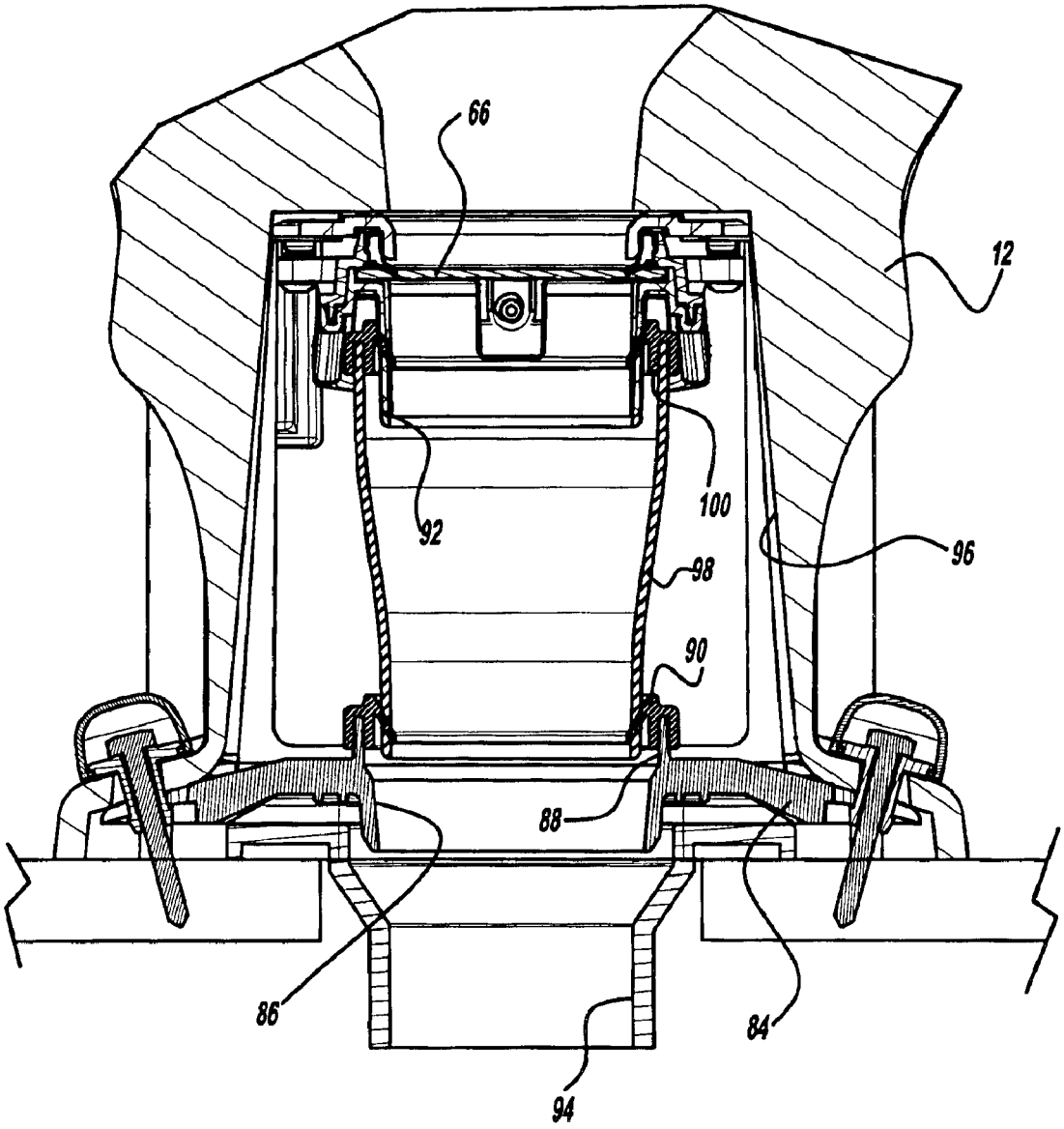
FIG. 8 is a fragmentary view like FIG. 7 but with a higher bowl.

Referring to FIGS. 7 and 8, it will be seen that one of the advantages of this invention is the adaptability of the invention to china toilets which are difficult to maintain tolerances. The china bowl 12 is a fired clay body having low porosity that resembles glass. As shown in FIG. 7, the toilet bowl 12 has a base 80 and a cavity 81 which extends upwardly in the bowl 12. The base 80 is adapted to be mounted on the floor and is retained on the floor by mounting bolts 82. The base 80 carries a fixture 84 which includes a tubular section 86, which is aligned with the bowl opening 16, and an upwardly extending annular rim 88. A seal member 90 made of rubber or the like is mounted on the rim 88 and sealingly abuts a tubular member 92 mounted to the bowl 12 below the side blade 66 and through which the water from the bowl 12 is directed downwardly into a floor mounted pipe 94 that extends into the holding tank (not shown). In the toilet shown in FIG. 7, the distance between the bowl opening 16 and the fixture 84 is minimal.

In FIG. 8, a toilet is shown in which the distance between the slide blade 66 and the base 84 is at a maximum. This maximum distance is achieved by a cavity 96, which is much longer than the cavity 81 in the bowl 12 shown in FIG. 7, and the bowl 12 is of a maximum height. In this cavity 96, a slip tube 98 is provided to accommodate the increased height of the cavity 96. The upper end of the slip tube 98 is provided with a seal 100 that is identical to the seal 90 in FIG. 7 and which telescopingly receives tubular section 92. The lower end of slip tube 98 is dimensioned to be the same as tubular section 92 and is telescopingly received in tubular section 86, sealingly engaged by seal 90. As such, the slip tube 98 allows the exact same parts to be used with a low height toilet 10 as with a "taller" height toilet 10 while providing a leak proof path for water from the bowl 12 to the floor mounted pipe 94. Like parts in FIGS. 7 and 8 are identified by similar numerals.

The use of the seals 90 and 100 in the toilets shown in FIGS. 7 and 8 enable the manufacture of leak proof passages in the bowls 12 even though the bowls are not of a consistent size because of the inherent characteristics of china clay.

In the use of the toilet 10, to institute full flush activation, the user depresses the button 54 on the pad 52 which is connected by wiring 59 to the circuit board assembly 58 which includes a microprocessor which signals to the dual solenoid water valve 60 which operates to alternately open and close the nozzles 30 and 32 and that sequence continues until the control board 58 times out. During the providing of water from the nozzles 30 and 32, the circuit board assembly 58 also activates the motor 70 to cause the slide blade 66 to open, removing all contents from the bowl 12. After a set amount of time, the circuit board assembly 58 also causes the motor 70 to close the slide blade 66. In case it is desired to clean the flush system, the button 56 can be repeatedly depressed to flush the system to the satisfaction of the user.

To add water to the bowl either before or following the full flushing of the toilet 10, a second button 56 can be depressed thereby signaling the circuit board assembly 58 to open both of the nozzles 30 and 32 at the same time so as to add more flush water to the bowl 12 in a very short time.

In light of the above, it is seen that this toilet 10 provides a china bowl 12 that can operate to uniformly wet the inside of the bowl 12 during a flushing operation. A modern electronically controlled flush water system provides for alternate flushing water on the contoured ledges 20 and 22 on the inside of the bowl. Similarly, the clutch drive for the slide valve 66 ensures a long life for the valve 66.

We claim:

1. A toilet for a support on vehicle floor associated with a discharge pipe, the toilet comprising:

a bowl including a discharge opening and a downwardly extending tubular member associated with the discharge opening;

a discrete annular flange member for sealing arrangement with the discharge pipe, the annular flange member extending outwardly from and over the discharge pipe and defining an aperture;

a slip tube having a first end coupled to the downwardly extending tubular member and a second end extending into the aperture of the annular flange member; and a seal member disposed between the second end of the slip tube and the aperture of the annular flange member, the slip tube configured for unobstructed vertical adjustment of the seal member, the seal member operable to seal the slip tube relative to the annular flange member when the slip tube extends into the aperture.

2. The recreation vehicle of claim 1, wherein the slip tube has top and bottom ends and annular seals at the top and bottom ends in sealing engagement with the annular flange member, respectively.

3. The recreation vehicle of claim 1, wherein the slip tube has top and bottom ends, the top end being larger in diameter than the bottom end.

4. The recreation vehicle of claim 1, wherein the sealing member circumferentially surrounds the second end of the slip tube.

5. The recreation vehicle of claim 1, wherein the sealing member allows the slip tube to be adjustably positioned relative to the aperture to accommodate size variations of the bowl.

6. The recreation vehicle of claim 1, wherein the sealing member is constructed of rubber.

7. The recreation vehicle of claim 1, wherein the slip tube operates as a vertical extension between the tubular member and the annular flange member.

8. The recreation vehicle of claim 7, wherein the first end of the slip tube telescopically receives the discharge opening.

9. A toilet for a support on vehicle floor associated with a discharge pipe, the toilet comprising:

a bowl including a discharge opening and a downwardly extending tubular member associated with the discharge opening;

an annular flange member for sealing arrangement with the discharge pipe, the annular flange member have a cylindrical wall defining an aperture;

a slip tube having a first end coupled to the downwardly extending tubular member and a second end extending into the aperture of the annular flange member; and a circular seal member having an inner circumferential surface and an outer circumferential surface, the circular seal member disposed between the second end of the slip tube and the aperture of the annular flange member, the inner circumferential surface abutting the slip tube and the outer circumferential surface abutting the wall such that the seal member maintains a seal between the slip tube and the annular flange throughout a range of telescopic adjustment therebetween.

10. The toilet of claim 9, wherein the circular seal member engages a radially outermost portion of the slip tube such that the slip tube is telescopically received by the annular flange member without interference from the annular flange member.

11. The toilet of claim 9, wherein the slip tube accommodates a height differential between the tubular member and the annular flange member.

12. The toilet of claim 9, wherein the slip tube has top and bottom ends in sealing engagement with the tubular member and the annular flange member, respectively.

13. The toilet of claim 9, wherein the slip tube has top and bottom ends, the top end being larger in diameter than the bottom end.

14. The toilet of claim 9, wherein the circular seal member is constructed of rubber.

15. The toilet of claim 9, wherein the slip tube operates as a vertical extension between the tubular member and the annular flange member.

16. The recreation vehicle of claim 15, wherein the first end of the slip tube telescopically receives the discharge opening.

17. A method of installing the toilet of claim 9, comprising the step of telescopically adjusting the slip tube relative to the annular flange member while maintaining a seal therebetween with the circular seal member.

* * * * *